US005595497A

United States Patent [19]

Wood

[11] Patent Number: 5,595,497

[45] Date of Patent: Jan. 21, 1997

[54] UNDERWATER ELECTRICAL CONNECTOR

[75] Inventor: Richard G. Wood, Magnolia, Tex.

[73] Assignee: Tescorp Seismic Products, Inc., Houston, Tex.

[21] Appl. No.: 396,960

[22] Filed: Mar. 1, 1995

[51] Int. Cl.[6] ..... H01R 13/405

[52] U.S. Cl. ..... 439/282; 439/606

[58] Field of Search ..... 439/278–282, 439/284, 293, 604, 606

[56] References Cited

U.S. PATENT DOCUMENTS

| | | | |
|---|---|---|---|
| H113 | 8/1986 | McNeel | 439/282 |
| 2,843,133 | 7/1958 | Barbara | 131/207 |
| 2,881,406 | 4/1959 | Arson | 439/589 |
| 3,124,405 | 3/1964 | Massa | 439/282 |
| 3,197,730 | 7/1965 | Hargett . | |
| 3,449,182 | 6/1969 | Wiltshire | 156/69 |
| 3,461,529 | 8/1969 | Van Dorn | 29/149.5 |
| 3,497,864 | 2/1970 | Barnet | 339/60 |
| 3,641,479 | 2/1972 | O'Brien et al. | 439/277 |
| 3,693,133 | 9/1972 | Harbonn et al. | 339/48 |
| 3,739,330 | 6/1973 | Hazelhurst et al. | 340/17 |
| 3,745,511 | 7/1973 | Fussell | 339/49 |
| 3,783,434 | 1/1974 | Ransford | 439/281 |
| 3,888,559 | 6/1975 | Geib . | |
| 3,937,545 | 2/1976 | Cairns et al. . | |
| 3,954,154 | 5/1976 | Kruppenbach et al. | 181/112 |
| 4,032,214 | 6/1977 | McNerney . | |
| 4,090,759 | 5/1978 | Herrmann | 439/281 |
| 4,150,866 | 4/1979 | Snyder et al. | 439/275 |
| 4,284,312 | 8/1981 | Patchett et al. | 439/281 |
| 4,355,855 | 10/1982 | Rebikoff . | |
| 4,445,741 | 5/1984 | Annoot | 339/49 |
| 4,480,151 | 10/1984 | Dozier | 174/153 R |
| 4,497,531 | 2/1985 | Baker | 439/587 |
| 4,588,247 | 5/1986 | Grappe et al. . | |
| 4,589,939 | 5/1986 | Mohebban et al. | 156/49 |
| 4,609,247 | 9/1986 | Annoot | 439/272 |
| 4,632,482 | 12/1986 | Punako et al. . | |
| 4,758,174 | 7/1988 | Michaels et al. | 439/281 |
| 4,767,349 | 8/1988 | Pottier et al. | 439/191 |
| 4,767,356 | 8/1988 | Grappe | 439/455 |
| 4,790,768 | 12/1988 | Domingues | 439/320 |
| 4,820,170 | 4/1989 | Redmond et al. | 439/66 |
| 4,861,288 | 8/1989 | Friedman | 439/736 |
| 4,921,452 | 5/1990 | Dozier | 439/622 |
| 5,014,813 | 5/1991 | Fussell | 181/122 |
| 5,120,237 | 6/1992 | Fussell | 439/282 |
| 5,120,268 | 6/1992 | Gerrans | 439/736 |
| 5,130,954 | 7/1992 | Fussell | 367/188 |
| 5,145,410 | 9/1992 | Maejima et al. | 439/587 |
| 5,183,966 | 2/1993 | Hurtado et al. | 474/20 |
| 5,199,893 | 4/1993 | Fussell | 439/271 |
| 5,297,974 | 3/1994 | Fussell | 439/320 |
| 5,362,258 | 11/1994 | Arnswald et al. | 439/695 |
| 5,387,119 | 2/1995 | Wood | 439/281 |

FOREIGN PATENT DOCUMENTS

| | | |
|---|---|---|
| 63398 | 8/1968 | Germany . |
| 2650240 | 2/1978 | Germany . |
| 2131633 | 6/1984 | United Kingdom . |

*Primary Examiner*—Neil Abrams

*Attorney, Agent, or Firm*—P. Weston Musselman, Jr.; Robert A. McFall; Jenkens & Gilchrist, P.C.

[57] ABSTRACT

An electrical connector assembly includes mating connectors each having a relatively soft outer housing encapsulating a core formed of a hard material. Electrical conductors are partially embedded in the core which extends around the contact portion of preselected conductors to from a rigid sheath around the respective contact. The housings have a bore extending inwardly from a face surface that, upon assembly with a mating connector, sealingly surrounds the rigid sheath of the mating connector. The electrical connectors provide improved open-face waterproof sealing of the connector assembly.

13 Claims, 2 Drawing Sheets

UNDERWATER ELECTRICAL CONNECTOR

TECHNICAL FIELD

This invention relates generally to an electrical connector and an assembly comprising a pair of electrical connectors, and more particularly to such a connector and assembly suitable for use in underwater applications.

BACKGROUND ART

Electrical connectors used in an underwater environment, and in particular in seismic exploration on an ocean floor, are subjected to high pressure which may cause leakage around the electrical contacts and subsequent failure of the electrical connection. Leakage of the connector assembly is a serious problem when face sealing of the connector members is relied upon to provide sealing of the mating contacts. U.S. Pat. No. 5,120,268, issued Jun. 9, 1992 to Al Gerrans discloses an underwater electrical connector having a relatively soft core in which electrical contact members are mounted. The soft core extends around the female contact member in the connector and, upon assembly of mating halves of the connector, is in intimate contact with a bore also formed in the relatively soft material of the core. It has been found that the sealing provided between two soft surfaces is less desirable than sealing a soft surface against a relatively hard surface.

The improved sealing action provided between relative hard and soft surfaces is disclosed in U.S. Pat. No. 5,387,119, issued Feb. 7, 1995 to Richard G. Wood, the inventor of the present invention. The later patent discloses an open-face waterproof electrical connector that provides sealing between a hard sheath surrounding an electrical contact and a relatively soft bore having a plurality of internally formed annular ridges, or O-ring type seals. One member of the connector is formed of single, relatively hard material that extends over the electrical contacts to form the hard sheath. The mating connector is formed of a single, relatively soft material in which the ridged bores were formed. The advantages of sealing a soft material against a hard surface as discussed in the above patent, as opposed to sealing between two soft surfaces, include decreased deformation and compression set. This arrangement described in U.S. Pat. No. 5,387,119 provides an excellent open-face waterproof connector when assembled, even underwater, but requires that each matable half of the connector assembly be separately formed of different materials. The term "open-face waterproof" means that the sealing of the electrically conductive components, against the entrance of water under pressure, is not dependent on a seal provided by a housing around the connector nor by contact between the respective faces of the mating members of an electrical connector assembly.

The present invention is directed to overcoming the problems set forth above. It is highly desirable to have an underwater electrical connector assembly having mating components that are open-face waterproof and can be constructed and arranged to provide a variety of male-female contact combinations. It is also desirable to have an underwater connector assembly in which both mating components may be formed with preformed cores of the same material that provides a hard sheath around selected contacts, and relatively soft, compressible molded housings that encapsulate the cores and provide a ridged bore that seals against and around each of the sheaths of a mating connector.

BRIEF SUMMARY OF THE INVENTION

In accordance with one aspect of the present invention, an electrical connector has a housing formed of a flexible, relatively soft, material having a hardness of from about 40 to about 80 durometer, and has one end that is matable with another connector and a second end that is encapsulated around a plurality of wire conductors. The housing also includes a face surface disposed near the matable end that has at least one bore extending inwardly from the face surface and is defined by a cylindrical wall having a plurality of annular ridges formed in the wall. The electrical connector also has a core encapsulated within the housing and is formed of a relatively hard material. A plurality of electrical conductors are disposed within the core, each having a first end adapted for connection with a wire conductor, a second end having a matable electrically conductive contact formed thereon, and a central body portion containing a plurality of lands and grooves formed on an outer surface. The core extends around preselected ones of the contacts and forms an open-ended sheath around the contact.

In another aspect of the present invention, an electrical connector assembly includes first and second connectors each having a relatively soft housing in which a core formed of a harder material is encapsulated. At least one of the cores in the assembly extends around one or more electrically conductive contacts and forms a hard sheath around the contact. At least one of the housings also have a bore extending inwardly from a face surface of the housing and has a plurality of annular ridges disposed therein which cooperates with a mating sheath to form a seal between the sheath and the bore.

BEST MODE FOR CARRYING OUT THE INVENTION

Figure 1:
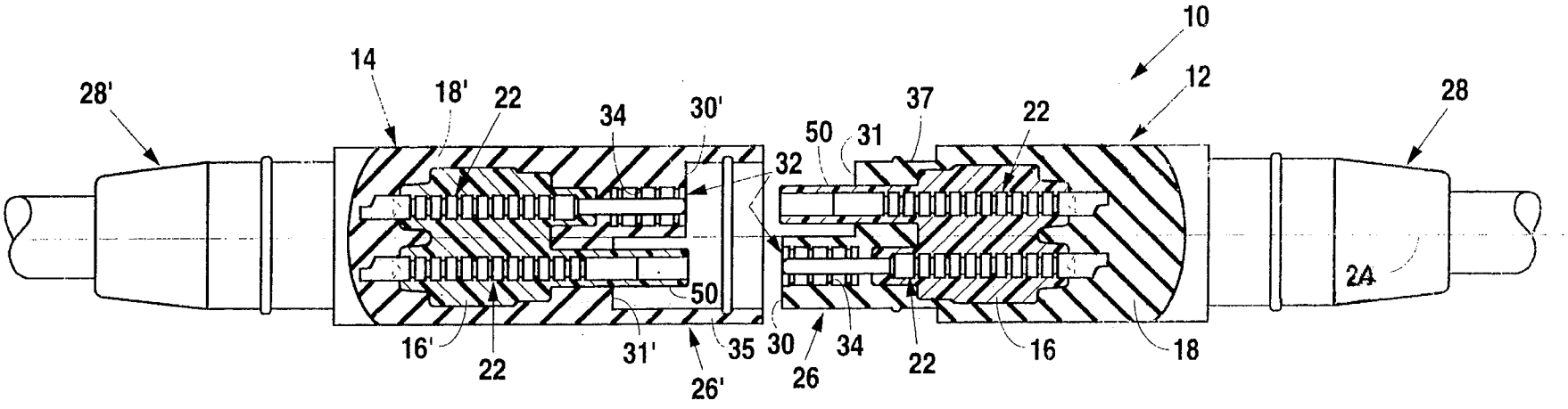
FIG. 1 is an exploded view of the electrical connector assembly embodying the present invention, with portions of each of the connectors in the assembly broken away to show internal details of the housing, core and conductor components of the assembly.

An open-face waterproof, underwater electrical connector assembly 10 embodying the present invention is shown in FIG. 1, and includes matable first and second members 12,14, each comprising a separate connector. In the preferred embodiment, each of the members 12,14 of the assembly 10 have identical cores 16 embedded within a housing 18,18'. For the sake of clarity in the following description, identical components in the assembly 10 are identified by a single reference number whether they be disposed in the first member 12 or in the second member 14. Similar components having the same function but differing only in selective shape, are identified with the same reference number with components disposed in the second member 14 having a prime (') placed after the number.

The housings 18,18' are formed of a flexible, relatively soft and electrically nonconductive material, such as polyurethane, having a hardness of from about 40 to about 80 durometer as measured on the Shore A scale. Other materials having the above properties may also be used, and desirably are moldable about the core 16 and during the molding operation bond to the core material without the aid of bonding agents or adhesives. That is, it is desirable that the materials be mutually self-bonding upon molding the housing 18 around the preformed core 16 and the wire conductors that are attached to electrical conductors 22 partially embedded in the core 16, and are described below in greater detail.

Each of the housings 18,18' are centrally formed about a longitudinal axis 24 and have a matable end 26,26' that upon assembly interconnect with a mating connector, a wire conductor encapsulating end 28 that is molded around the wire cable and individual leads, and a face surface 30,30' disposed at, or near, the matable end 26,26'. In the preferred embodiment of the present invention, each of the connectors 12,14 have stepped faces consisting of the above first mentioned face surfaces 30,30', defined by a semicircular surface extending outwardly from the longitudinal axis 24, and a second semicircular face surface 31,31' extending radially outwardly from the longitudinal axis 24 at a spaced distance behind the first face surface 30,30'. Each of the first mentioned face surfaces 30,30' have at least one bore 32 (or more, depending on the total number of electrical conductors 22 in the assembly 10) extending inwardly from the respective face surface 30,30'. The bores 32 are defined by a cylindrical wall surface having a plurality of radially inwardly extending annular ridges 34 formed on the cylindrical wall surface.

The leftwardly positioned second connector 14 has a circumferentially disposed annular wall portion 35 disposed adjacent the matable end 26' of the connector 14. The annular wall 35 is adapted to tightly engage an inwardly stepped portion 37 formed on the exterior of the first connector 12 upon joining the connectors 12,14 with each other.

Each of the cores 16 respectively encapsulated within the housings 18,18' are formed of a relatively hard, electrically nonconductive material, such as glass filled polyurethane, that has a hardness greater than that of the housings 18,18'. Preferably the material forming the cores 16 is self bonding with the material used in molding the respective housing 18,18' around the core 16, and further has a small but controlled amount of shrinkage upon solidification to provide permanent biased contact with the embedded portion of each of the electrical conductors 22. Other suitable material combinations include an injection moldable blend of polyethylene and neoprene rubber for the housings 18,18' and high density polyethylene for the core 16.

Figure 2:
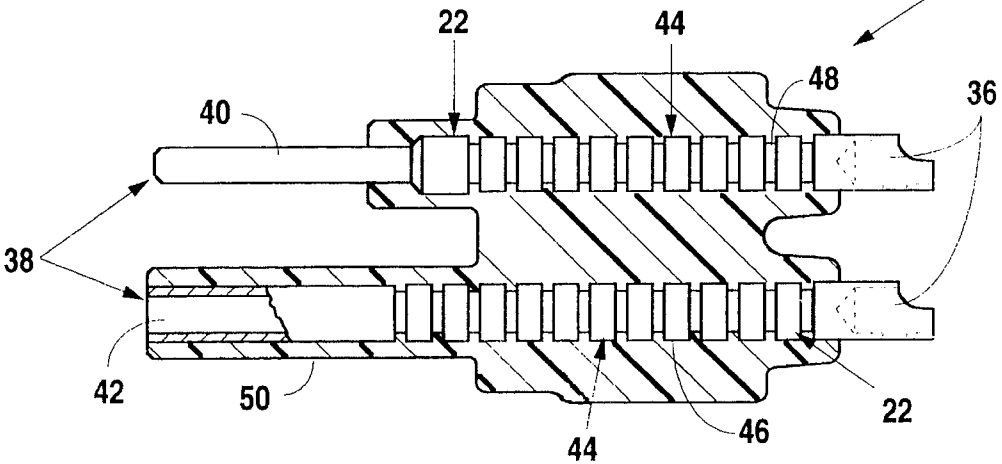
FIG. 2 is a sectional view of the core component of the electrical connectors embodying the present invention.

As best shown in FIG. 2, a plurality of the electrical conductors 22 are partially embedded within the core 16. Each of the electrical conductors 22 have a first end 36 to which a wire is attached, such as by soldering to a lug provided on the first end, and a second end on which a matable electrically conductive contact 38 is formed. Depending on the configuration of a particular connector, the electrically conductive contact 38 may be either a male member, i.e., an electrically conductive pin 40, or a female member such a conventional electrically conductive sheath 42 adapted to receive the pin. In the illustrative embodiment of the present invention shown in FIGS. 1 and 2, an even number of the electrical conductors 22 are arranged in a symmetrical pattern about the longitudinal axis 24 with half of the conductors 22 being disposed elevationally above the axis 24 and the remaining half of the conductors 22 disposed below the axis 24. In the sectional views in the drawings, for simplicity only two conductors 22, i.e., one pin 40 and one sleeve 42, are shown in each core 16. However, it should be understood any reasonable number of conductors 22 may be disposed in each core 16, and if the total number of conductors 22 in each core are even and symmetrically arranged, the same core 16 may be advantageously used in both connectors 12,14 of the assembly 10. For example, in the preferred embodiment of the present invention, half of the electrical conductors 22 have a pin 40 formed at the second end of the conductor 22, and the remaining half have a sleeve 42 respectively disposed at second end of the conductor 22. Thus, by simply rotating one of the cores 16 180° about the longitudinal axis 24, before encapsulation in the housings 18,18', the same premolded core 16 with conductors 22 embedded therein, can be used in both connectors 12,14. This arrangement provides important economic benefits in the construction of the assembly 10. However, if required or otherwise desired, an odd number of conductors 22 may also be arranged in each core 16. Also, if desired all of the conductors 22 in a respective core 16 may have the same configuration, that is, one core 16 in the assembly 10 may have only pin-type contacts 40 and the mating core 16 in the assembly 10 may have only sleeve-type contacts 42.

Importantly, each of the electrical conductors 22 have a central body portion 44 in which its outer surface is defined by a plurality of lands 46 and grooves 48. This configuration provides greater contact surface area between the conductor 22 and the surrounding core 16 which, if constructed of the above described relatively hard glass filled polyurethane or polyethylene material, will assure a tight, waterproof joint between the core 16 and the conductors 22.

The core 16 also extends outwardly toward the second end of the conductors 22, and forms a hard sheath 50 about selected ones of the electrically conductive contacts 38. The slight shrinkage of the core material during solidification forms a permanent biased interface between the sheath 50 and the respectively enshrouded contact 38. In the preferred embodiment, the core 16 forms a hard, open-ended sheath 50 around the sleeves 42 that has a diameter slightly greater than the inner diameter of the annular ridges 34 formed in the bore 32 of the housings 18,18' so that, when the connectors 12,14 are assembled, each of the ridges 34 form a lip, or O-ring type, seal about the circumference of each sheath. Furthermore, it can be seen that, due to the relative soft material comprising the housings 18,18', when external pressure is isostatically applied about the external surfaces of the connectors 12,14 the bores 32 are also compressed and the sealing pressure of the ridges 34 against the hard surfaced sheaths 50 is also increased. These conditions are typically encountered in underwater applications, where water pressure compresses the relatively soft housings 18,18' and increases sealing at the ridge 34 to sheath 50 interface. Alternatively, as described in the above reference U.S. Pat. No. 5,387,119, the hard sheath 50 may be formed around the pins 40 and the ridged bore 32 provided in association with the sleeve 42.

Thus, it can be seen that effective waterproof seals are provided between the housings 18,18' and the core 16 by bonded, either mutually self-bonded or adhesively, joining of the two components. Also, a waterproof seal is provided around the each of the conductors 22 by the biased embedment of the multiple-grooved central body portion 44 within the core, and around each separate mated electrical contact by compression of the compressible ridges 34 against a corresponding hard-surfaced sheath 50. This construction enables the electrical connector assembly 10 to be used underwater without requiring that the respective face surfaces 30,30' be sealed, either by forced biased abutment or by external seals, and is therefore open-face waterproof even with the face surfaces 30,30' open and exposed to external pressure.

Furthermore, the electrical connector assembly 10 may be connected underwater. When the connectors 12,14 are mated, or connected, underwater, the ridges 34 effectively pump water away from the pin-socket connection. It has been found that, after initial connection, if the connectors 12,14 are moved apart abut ¼ inch (0.64) cm and then rejoined, the ridges 34 coact with the hard-surfaced sheath 50 to provide a pumping action that further clears water from the pin-socket juncture.

Figure 3:
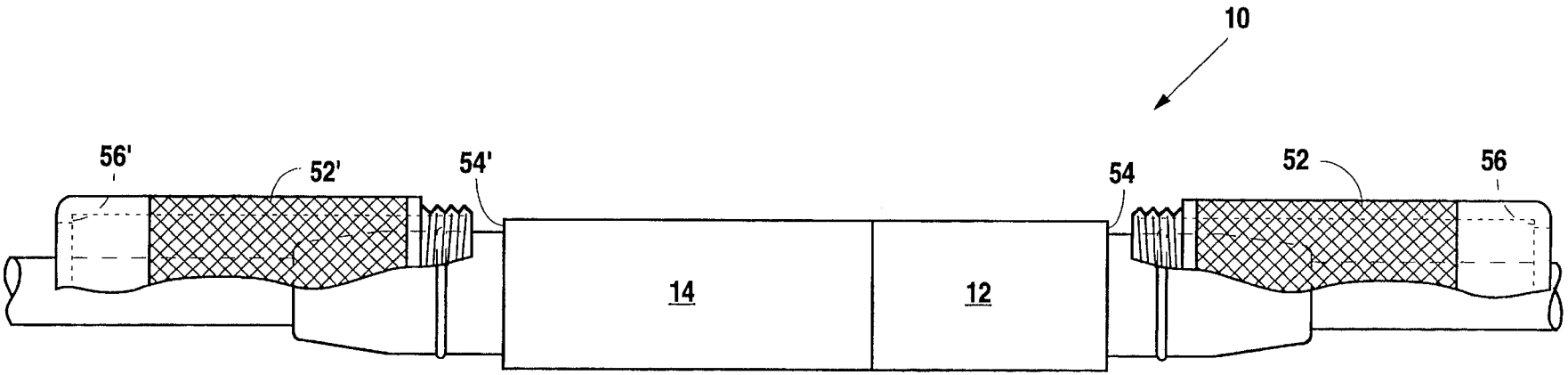
FIG. 3 is an exploded view of an outer shell useful in an alternative embodiment of the present invention, with portions of the shell broken away to show the assembled electrical connectors in elevation.

The relatively soft outer housings 18,18' of the connectors 12,14 also provide a beneficially tactile surface for gripping when joining or separating the electrical connector assembly 10 embodying the present invention. However, in certain applications and environments, it is desirable to have a rigid, abrasive resistant outer shell surrounding the connector assembly. For such purposes, an separable shell consisting of first and second members 52,52' is shown in FIG. 3. The members 52,52', preferably formed of stainless steel, are separately predisposed on the cable associated with each of the connectors 12,14 and, after joining the connectors 12,14 together, the members 52,52' are moved toward each other and threaded together. The inner diameter of the members 52,52' is desirably slightly larger than the outer diameter of the housings 18,18'. The housings 18,18' have a radial shoulder 54,54' that cooperates with an inwardly extending radial flange 56,56' on the shell members 52,52' to longitudinally position the shell members 56,56' and prevent unintended separation of the connector assembly 10.

Industrial Applicability

The present invention is particularly useful in applications that require sealing of electrical connections against adverse environmental conditions such as underwater data acquisition and transmission systems, subsurface or ground level instruments subjected to adverse operational and atmospheric environments such as seismic exploration applications, and other uses where it is desirable to protect the electrical contact portions of the connector from water infiltration. Importantly, the electrical connector 10 embodying the present invention comprises connectors that can be joined together, even underwater, without the need of special tools or equipment.

The present invention, because of the encapsulated core that provides a hard reaction surface about selected electrical contact members, and the sealing around the sheaths that is provided by the softer housing, has important uses in applications where the electrical connector is subjected to high vibration or shock, such as in rough terrain vehicles and earthmoving machines.

Other aspects, features and advantages of the present invention can be obtained from a study of this disclosure together with the appended claims.

What is claimed is:

1. An electrical connector, comprising:

a housing formed of a flexible, relatively soft, electrically nonconductive material having a hardness of from about 40 to about 80 durometer as measured on the Shore A scale, and having a centrally disposed longitudinal axis, a matable end, a wire conductor encapsulating end spaced along said longitudinal axis from said matable end, a face surface disposed in proximate relationship to said matable end and having at least one bore extending inwardly from said face surface, said bore being defined by a cylindrical wall surface having a plurality of radially inwardly extending annular ridges formed on said cylindrical wall surface and adapted to form a seal between said bore and a sheath surrounding an electrically conductive contact of a mating connector when said mating connector is operably assembled with said electrical connector; and, a core encapsulated within said housing and formed of a relatively hard, electrically nonconductive material having a hardness greater than the hardness of said housing and having a plurality of electrical conductors at least partially embedded therein, each of said electrical conductors having a first end adapted for connection with a wire conductor, a second end having a matable electrically conductive contact formed thereon, and a central body portion having an outer surface defined by a plurality of lands and grooves, said core extending around at least preselected ones of said electrically conductive contacts and forming an open-ended sheath around the respective electrical contact, said sheath having a hardness equal to the hardness of said core.

2. An electrical connector, as set forth in claim 1, wherein said sheath is in intimate contact with an outer surface of said electrical contact and bonded thereto.

3. An electrical connector, as set forth in claim 1, wherein said electrically conductive contacts are symmetrically arranged about said longitudinal axis.

4. An electrical connector, as set forth in claim 3, wherein a first half of said electrically conductive contacts are electrically conductive pins, and a second half of said electrically conductive contacts are electrically conductive sleeves adapted to receive an electrically conducive pin therein.

5. An electrical connector, as set forth in claim 3, wherein said housing has a first face surface and a second face surface, said face surfaces being defined by a semicircular surface extending radially outwardly from said longitudinal axis and spaced apart by a predetermined distance along said longitudinal axis.

6. An electrical connector, as set forth in claim 1, wherein said housing has a circumferentially disposed annular wall portion disposed adjacent said matable end of the connector.

7. An electrical connector, as set forth in claim 1, wherein said flexible, relatively soft, electrically nonconductive material forming said housing and said relatively hard, electrically nonconductive material forming said core are mutually self-bonding moldable materials.

8. An electrical connector, as set forth in claim 7, wherein said flexible, relatively soft, electrically nonconductive material forming said housing is a thermoplastic polyurethane material and said relatively hard, electrically nonconductive material forming said core is a glass filled polyurethane material.

9. An electrical connector assembly, comprising:

A first member having a flexible, relatively soft outer housing having a hardness of from about 40 to about 80 durometer as measured on the Shore A scale, a centrally disposed longitudinal axis, a matable end, and a wire conductor encapsulating end spaced along said longitudinal axis from said matable end; a core encapsulated within said housing and formed of a relatively hard, electrically nonconductive material having a hardness greater than the hardness of said housing and having a plurality of electrical conductors at least partially embedded in said core, each of said electrical conductors having a first end adapted for connection with a wire conductor, a second end having a matable electrically conductive contact formed thereon, and a central body portion having an outer surface defined by a plurality of lands and grooves; and, a second member matable with said first member and having a flexible, relatively soft outer housing having a hardness of from about 40 to about 80 durometer as measured on the Shore A scale, a centrally disposed longitudinal axis that is congruent with the longitudinal axis of said first member upon assembly of said first and second members, a matable end, and a wire conductor encapsulating end spaced along said longitudinal axis from said matable end; a core encapsulated within said housing and formed of a relatively hard, electrically nonconductive material having a hardness greater than the hardness of said housing and having a plurality of electrical conductors at least partially embedded in said core, each of said electrical conductors having a first end adapted for connection with a wire conductor, a second end having a matable electrically conductive contact formed thereon, and a central body portion having an outer surface defined by a plurality of lands and grooves;

at least one of the cores of said first and second members extending over the second end of preselected electrical conductors and forming an open-ended sheath around the respective electrically conductive contact formed on said second end;

at least one of the housings of said first and second members having a face surface disposed in proximate relationship to said matable end, and having at least one bore extending inwardly from said face surface, said bore being defined by a cylindrical wall surface having a plurality of annular ridges formed on said cylindrical wall surface and being matable with a respectively disposed sheath surrounding an electrically conductive contact on an oppositely disposed member to form a seal between said sheath and said bore.

10. An electrical connector assembly, as set forth in claim 9, wherein the cores of said first member and said second member are identical premolded components and each of said cores extends around respective preselected ones of said electrically conductive contacts and forms an open-ended sheath around said respective contact, said sheath having a hardness equal to the hardness of said core.

11. An electrical connector assembly, as set forth in claim 9, wherein the electrically conductive contacts disposed in the first and second members are symmetrically arranged about the respective longitudinal axis associated with each member.

12. An electrical connector, as set forth in claim 11, wherein a first half of said electrically conductive contacts in each of said first and second members are electrically conductive pins, and a second half of said electrically conductive contacts in each of said first and second members are electrically conductive sleeves adapted to receive an electrically conducive pin therein.

13. An electrical connector assembly, as set forth in claim 9, wherein said assembly includes a separable shell adapted to encircle the housings of said first and second members of the electrical connector assembly after said members are joined together in mating relationship.

* * * * *